US009587837B2

(12) United States Patent
Colucci et al.

(10) Patent No.: US 9,587,837 B2
(45) Date of Patent: Mar. 7, 2017

(54) DOOR LOCK DEVICE

(71) Applicant: Bitron S.p.A, Turin (IT)

(72) Inventors: Stefano Colucci, Turin (IT); Gianpaolo Barone, Turin (IT)

(73) Assignee: Bitron S.P.A., Turin (IT)

( * ) Notice: Subject to any disclaimer, the term of this patent is extended or adjusted under 35 U.S.C. 154(b) by 0 days.

(21) Appl. No.: 14/945,508

(22) Filed: Nov. 19, 2015

(65) Prior Publication Data

US 2016/0138809 A1 May 19, 2016

(30) Foreign Application Priority Data

Nov. 19, 2014 (IT) ..... 102014902310656

(51) Int. Cl.
*E05C 19/10* (2006.01)
*F24C 15/02* (2006.01)
(Continued)

(52) U.S. Cl.
CPC ..... *F24C 15/022* (2013.01); *E05B 15/0046* (2013.01); *E05B 47/0603* (2013.01);
(Continued)

(58) Field of Classification Search
CPC .... Y10S 292/69; E05B 17/0029; E05B 81/00; E05B 81/04; E05B 15/0046;
(Continued)

(56) References Cited

U.S. PATENT DOCUMENTS 1,272,710 A * 7/1918 Ramsher ..... E05B 63/20 292/153
2,129,412 A * 9/1938 Edele ..... E05C 17/085 292/271
(Continued)

FOREIGN PATENT DOCUMENTS

EP 2450510 A2 5/2012
FR 2687718 A1 8/1993
(Continued)

OTHER PUBLICATIONS

Translated Search Report from corresponding priority application; dated Jul. 9, 2015.

*Primary Examiner* — Daniel J Troy
*Assistant Examiner* — Andres Gallego
(74) *Attorney, Agent, or Firm* — Harness, Dickey & Pierce, P.L.C.

(57) ABSTRACT

A door-lock device for retaining a door of a household appliance in a closed position. The door-lock device including a mobile module that slides relative to the door of the household appliance and a blocking unit housed within the mobile module. The blocking unit has a blocking member that moves between an unlocking position and a locking position. In the locking position, the blocking member holds the door of the household appliance in the closed position. A detecting slider slides the mobile module relative to the door of the household appliance and a blocking slider prevents the blocking member from moving from the locking position to the unlocking position. A pawl connected to
(Continued)

the blocking slider engages one of a plurality of adjustment slots to block the door.

8 Claims, 4 Drawing Sheets

(51) Int. Cl.

| | |
|---|---|
| ***E05C 19/00*** | (2006.01) |
| ***E05C 19/02*** | (2006.01) |
| ***E05B 47/06*** | (2006.01) |
| ***E05B 63/20*** | (2006.01) |
| ***E05B 15/00*** | (2006.01) |
| ***F24C 14/02*** | (2006.01) |

(52) U.S. Cl.
CPC ..... *E05B 63/20* (2013.01); *E05C 19/00* (2013.01); *E05C 19/02* (2013.01); *E05C 19/10* (2013.01); *F24C 14/02* (2013.01); *Y10T 292/1082* (2015.04)

(58) Field of Classification Search
CPC ..... E05B 47/0603; E05B 63/20; E05C 19/02; E05C 19/10; Y10T 292/1082
See application file for complete search history.

(56) References Cited

U.S. PATENT DOCUMENTS

| | | | | |
|---|---|---|---|---|
| 6,209,364 | B1 * | 4/2001 | Collet | E05C 9/042 292/39 |
| 6,334,637 | B1 * | 1/2002 | Chioffi | D06F 37/42 292/341.16 |
| 8,109,543 | B2 * | 2/2012 | Chirumbolo | E05B 15/101 126/197 |
| 2005/0194795 | A1 | 9/2005 | Hapke | |
| 2007/0241568 | A1 * | 10/2007 | Harrer | F24C 15/022 292/144 |
| 2008/0042447 | A1 * | 2/2008 | Neumann | A47L 15/4259 292/126 |
| 2010/0052338 | A1 | 3/2010 | Osvatic | |

FOREIGN PATENT DOCUMENTS

| | | | | |
|---|---|---|---|---|
| IT | 1304436 | A2 | 4/2003 | |
| IT | EP 2846099 | A1 * | 3/2015 | D06F 37/42 |
| WO | 2010041210 | A1 | 4/2010 | |

* cited by examiner

DOOR LOCK DEVICE

CROSS-REFERENCE TO RELATED APPLICATIONS

This application claims the benefit and priority of Italian Patent Application No. 102014902310656, filed Nov. 19, 2014. The entire disclosure of the above application is incorporated herein by reference.

FIELD

The present invention relates to a door-lock device.

BACKGROUND

More specifically, the invention concerns a door-lock device of the above kind, studied and realized in particular to allow the optimal closing of the door of a household appliance, in particular an oven, capable of compensating any tolerances and plays, but that can be used for the closure of any door, which has to be closed in an optimal way.

SUMMARY

In the following, the description will be directed to the application to an oven, but it is clear that the same should not be considered limited to this specific use.

As it is well known, at present there are certain types of ovens, which have the function of automatic cleaning of the cooking compartment, by means of a pyrolysis mechanism. In particulate, this type of oven involves the pyrolysis of fatty residues of the cooked foods, subjecting the cooking compartment at a temperature of about 600° C., so that residue fats are subjected to a pyrolysis process and transformed into powder, so as to be easily collected and disposed of.

That function, on one hand is very convenient for the ease and convenience of cleaning the oven, on the other hand is also very dangerous. In fact, an opening of the oven door, could cause serious damages to a user.

To solve this problem, the existing ovens of the type described above are usually equipped with a motorized device, which locks the door. Such a solution, although effective, is expensive, being high in overall production costs.

It is evident, therefore, that this solution is expensive in economic terms.

In light of the above, it is, therefore, an object of the present invention to provide a door-lock device which, when the function of automatic cleaning is started, can lock the oven door, to prevent accidental openings.

It is a further object of the present invention that the door-lock device according to the invention is capable of compensating any closing tolerances of the door.

It is therefore an object of the present invention to provide a door-lock device to retain a door of a household appliance in the closed position, such as an oven and the like, said door being of the type equipped with a locking pin, said door-lock device comprising a mobile module, slidably movable with respect to said household appliance and arranged in correspondence of said locking pin, said mobile module having a container, capable of assuming an initial position, in which it is retained by pushing means, such as a spring and the like, a blocking unit, housed within said container, having a blocking member, integral with said mobile module, capable of assuming an unlocking position and a locking position, in which it is arranged so as to retain said locking pin when said door is closed, a detecting slider movable between an initial stroke position, in which it does not interact with said locking pin of said door, up to a final stroke position, in which said detecting slider interacts with said mobile module, so as to make it sliding, moving it from said initial position, a blocking slider capable of assuming a rest position and an operative position, in said operative position said blocking slider preventing that said blocking member can move from said locking position to said the unlocking position, and a pawl integral with said blocking slider, capable of engaging with one of a plurality of adjustment slots, the position of which is integral with said household appliance when said blocking slider is in said operative position, so as to block said door.

Always according to the invention, said door-lock device could comprise a plate, fixed to said household appliance, on which said adjustment slots are obtained, said mobile module being slidably coupled with said plate.

Still according to the invention, said detecting slider could be arranged alongside to said blocking member and has an appendix intended to interact with said locking pin when said door is closed.

Advantageously according to the invention, said detecting slider could comprise a relief to retain said blocking member in said unlocked position when said detecting slider is in said initial stroke position.

Further according to the invention, said blocking member could be rotatably coupled with said container and could comprise a body and a hook, and said blocking slider could comprise a projection which, when said blocking slider assumes said operative position, is arranged in correspondence of said body of said blocking member, so as to prevent, with its own encumbrance, that said blocking member can move from said locking position to said unlocking position, and a further lateral relief, shaped so that when said blocking slider is in said rest position, said pawl is kept raised by said further lateral relief, while when said blocking slider is in said operative position, said pawl is lowered, so as to engage with one of said adjustment slots.

Always according to the invention, said pawl could be rotatably coupled with said blocking slider.

Still according to the invention, said device could comprise an actuator module adapted to make said blocking slider passing from said rest position to said operative position.

Further according to the invention, said actuator module could comprise an electronic control unit, connected to, or integrated into, the logic control of said household appliance, and a coil, operatively connected to said electronic control unit, having a movable core connected by a rod to said blocking slider.

DRAWINGS

The present invention will be now described, for illustrative but not limitative purposes, according to its preferred embodiments, with particular reference to the figures of the enclosed drawings, wherein.

DETAILED DESCRIPTION

In the various figures, similar parts will be indicated by the same reference numbers.

Figure 1:
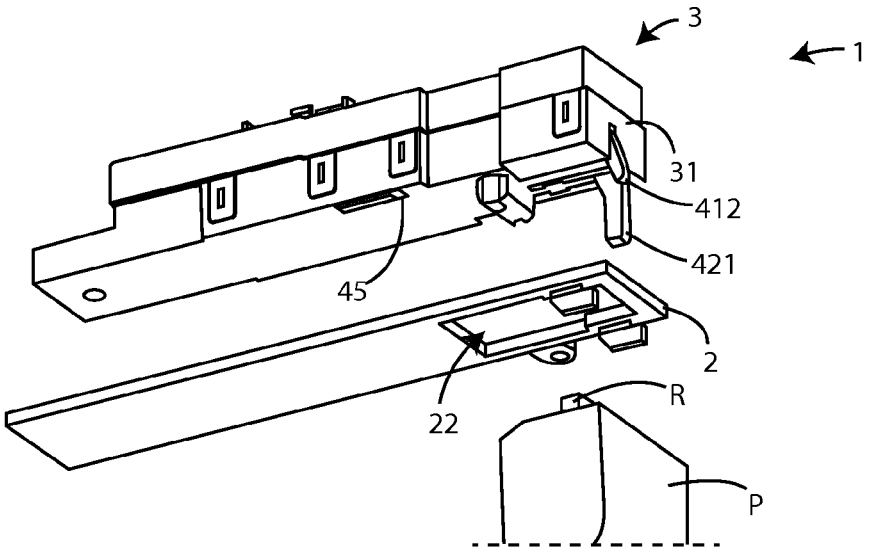
FIG. 1 shows a perspective view of a door-lock device according to the present invention.
Figure 2:
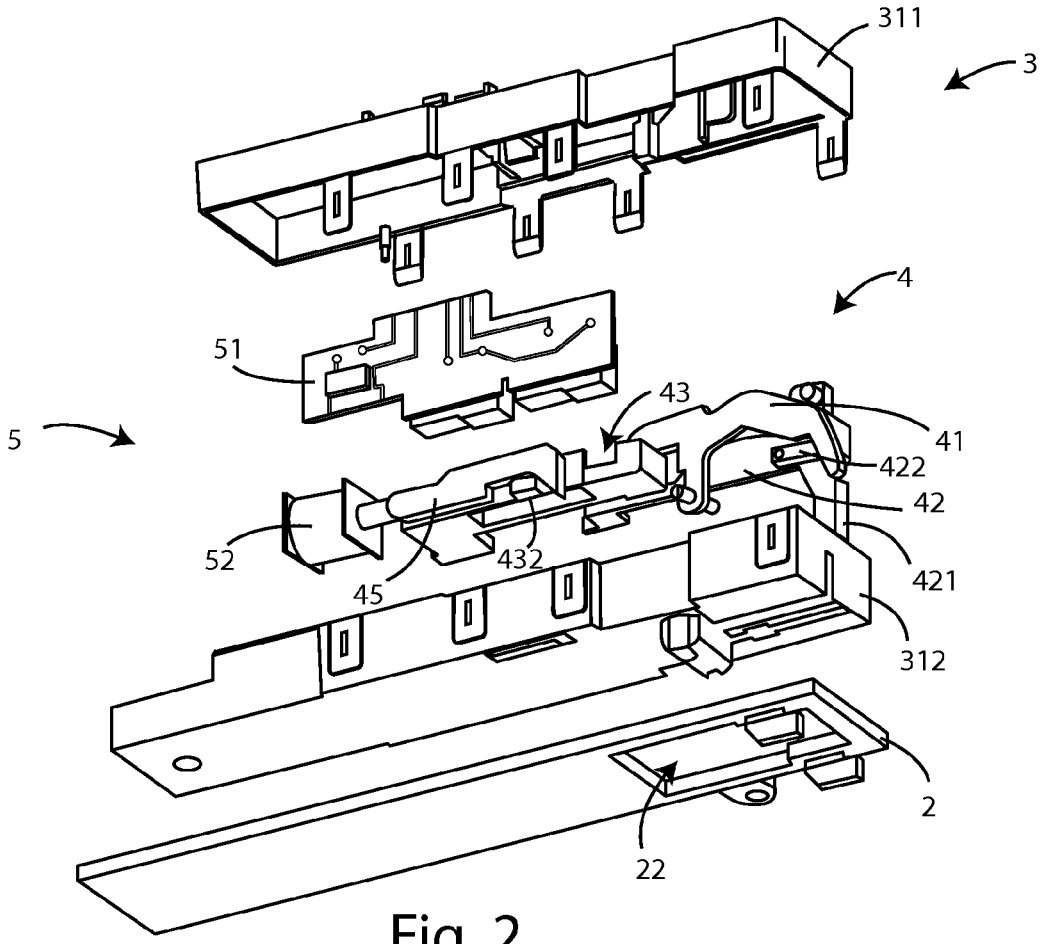
FIG. 2 shows an exploded view of the door-lock device according to FIG. 1.
Figure 3:
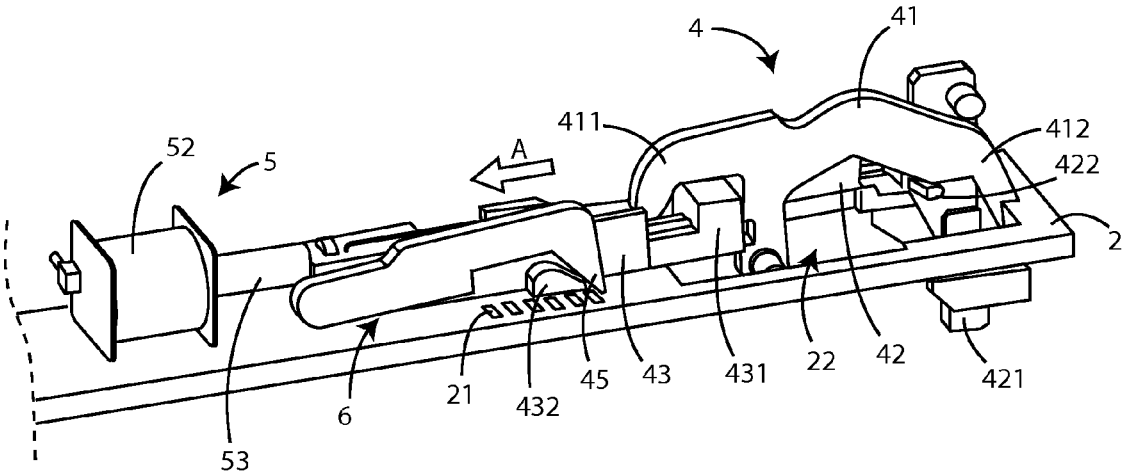
FIG. 3 shows the internal mechanisms of the door-lock device according to FIG. 1.

Referring to FIGS. 1-3, it is observed a door-lock device 1 according to the present invention, capable of retaining closed a door P of a household appliance, particularly an oven F and the like, said door P being of the type provided with a locking pin R.

In particular, the door-lock device 1 comprises a plate 2 and a mobile module 3, coupled with said sliding plate 2 and longitudinally movable with respect to it.

Said plate 2 is fixed on the upper part of the oven or household appliance, where the door-lock device 1 is installed, in correspondence of the closing of the door P.

On said plate 2, a series of adjustment grooves 21 and an opening 22 is formed, which functions, also in this case, will be better defined in the follow.

The mobile module 3 includes a container 31, in which a blocking unit 4 and an actuator module 5 are housed, which is capable of interacting with said blocking units 4.

The container 31 has an upper half-shell 311 and a lower half-shell 312, the latter being slidably coupled with said plate 2.

The blocking unit 4 comprises a blocking member 41, rotatably pivoted to said container 31 and having a body 411 and a hook 412, capable of assuming an unlocking position and a locking position, in which it is arranged so as to block the locking pin R of said door P. In said locking position said hook 412 passes through said opening 22.

Said blocking unit 4 also includes a detecting slider 42 of the door P and a blocking slider 43.

Said detecting slider 42, arranged beside said blocking member 41 and having an appendix 421, arranged across said opening 22 and intended to interact with said locking pin R for closing said door P, so as to hold it. Said detecting slider 42 comprises also a sensing relief 422, adapted to retain said blocking member 41 in said rest position.

Said detecting slider 42 is movable between a starting position, in which it is retained by first elastic means, as a first pushing spring and the like (not shown in the figures), and wherein said relief 422 holds said locking member 41 in said rest position; and a stroke end position, which it assumes by sliding in the direction of arrow A, until it meets an abutment (not visible in the figure) formed on said container 31.

Said blocking slider 43 comprises a projection 431 arranged at one end, and a further lateral relief 432, which function will be better defined in the following. Said blocking slider 43 is capable of assuming a rest position, in which it is retained by second pushing means, such as a second spring and the like (not shown in the figures) and an operating position, in which said projection 431 is arranged in correspondence of said body 411 of said blocking member 41, so as to prevent, with its dimensions, that said blocking member 41 can move from said locking position to said unlocking position.

The blocking module 4 also comprises a pawl 45, pivoted with said container 31 and arranged in correspondence of said lateral relief 432, such that when said blocking slider 43 is in said first position, said pawl 45 is kept raised by said further lateral relief 432, while when said blocking slider 43 is in said second position, said pawl 45 is lowered, so as to insert and to engage with one of said adjustment grooves 21.

Said actuator module 5 comprises an electronic control unit 51, connected to (or integrated in) the control logic of the household appliance, and a coil 52, operatively connected to said electronic control unit 51, in which a movable core is placed (not shown in the figure), such that when said coil 52 is energized, it attracts the movable core inside. Said movable core is connected, by means of a rod 53, to said blocking slider 43.

The operation of the door-lock device 1 described above is as follows.

Figure 4:
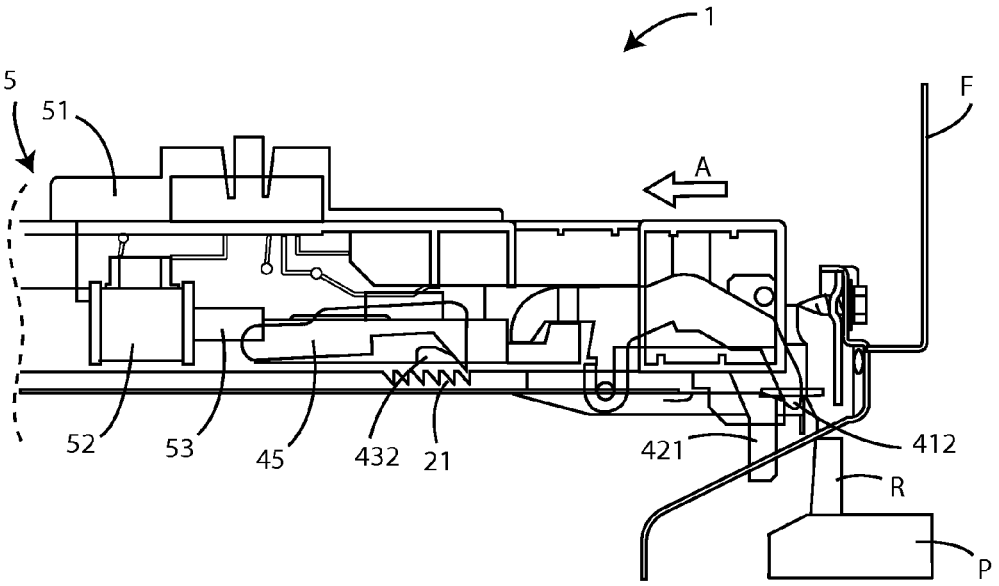
FIG. 4 shows a sectional side view of the door-lock device installed in the configuration in which the household appliance door is open.

Referring to FIG. 4, the door-lock device 1 is observed when the door P of the oven or of the household appliance in general, is open.

In this configuration, said detecting slider 42 is in said starting position, so that said relief 422 holds said blocking member 41 in said unlocked position, said blocking slider 43 is in said rest position and the coil 52 of said actuator module 5 is not energized.

Figure 6:
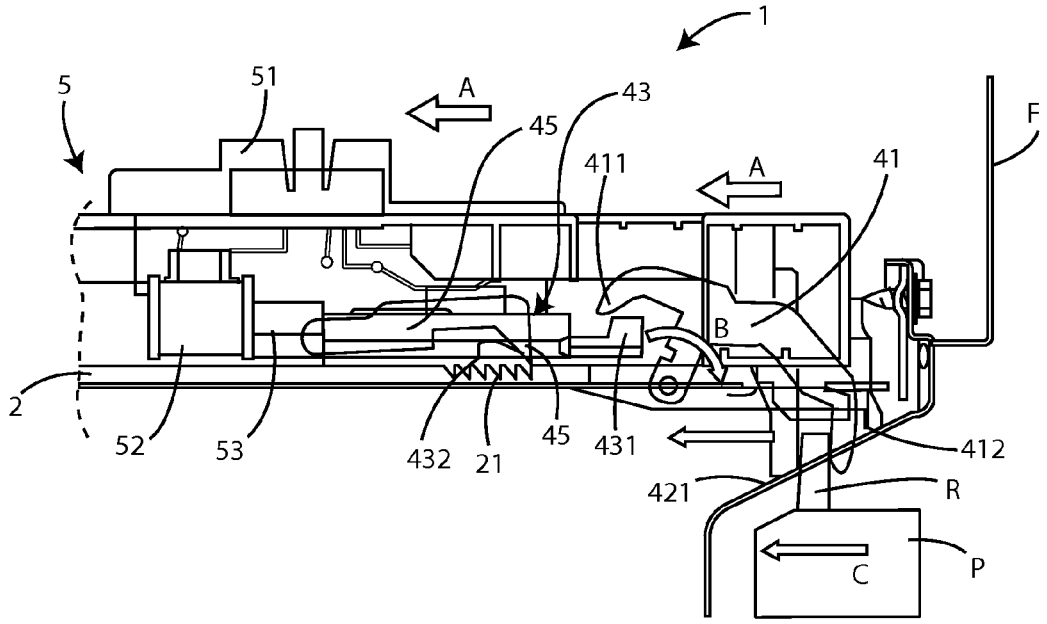
FIG. 6 shows a sectional side view of the door-lock device in the closed configuration.
Figure 7:
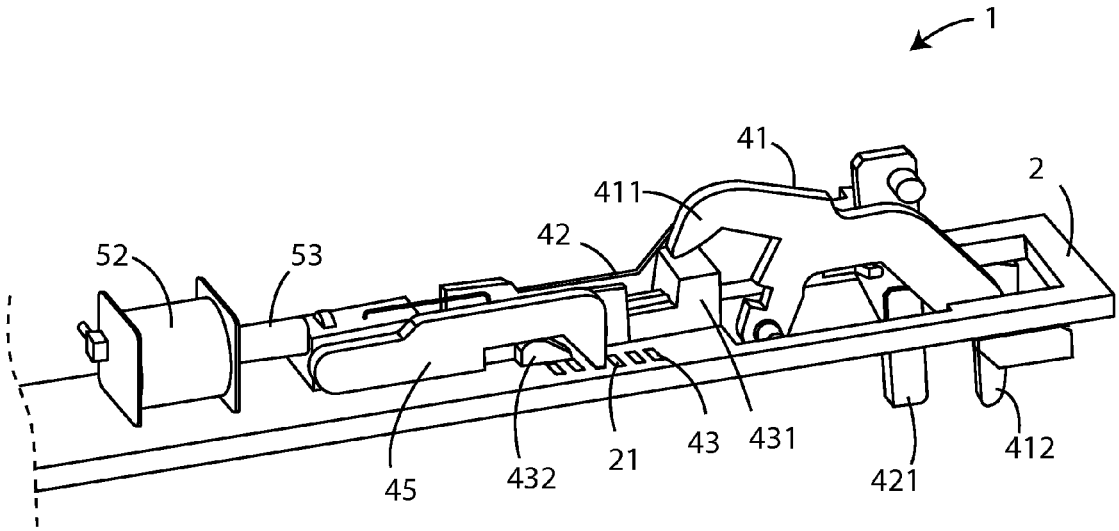
FIG. 7 shows the internal mechanisms of the door-lock device in the locking configuration.
Figure 8:
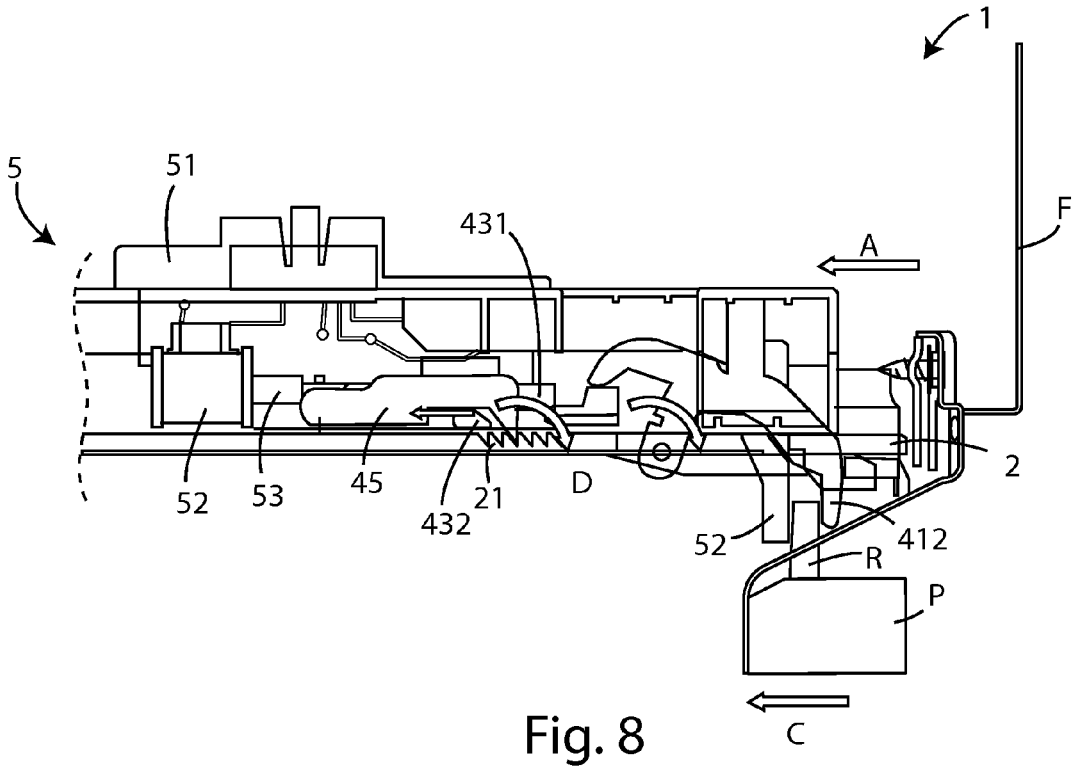
FIG. 8 shows a sectional side view of the door-lock device in the locking configuration.

When the door P is closed, the door-lock device 1 is capable of assuming a closed configuration that can be blocked (FIGS. 5 and 6) and a blocked closed configuration (FIGS. 7 and 8).

Figure 5:
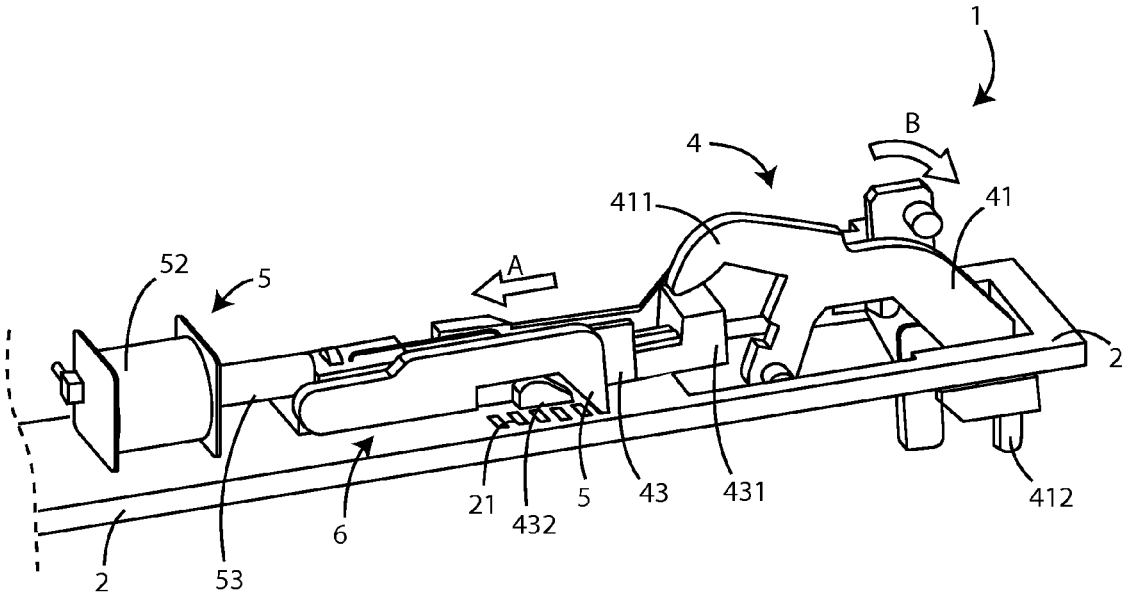
FIG. 5 shows the internal mechanisms of the door-lock device in the closed configuration.

In particular, as shown in FIGS. 5 and 6, the door-lock device 1 moves to the lockable closed configuration when the door P is closed according to the arrow C, whereby the locking pin R interferes with said appendix 421 of said detecting slider 42, so that said detecting slider 42 starts to move in the direction A, overcoming the resistance of the pushing spring, so that the blocking member 41 disengages from said relief 422, rotates according to said arrow B and said hook 412 can be placed behind said locking pin R of said door P. At the same time, the lateral relief 432 maintains the pawl 45 raised. In this configuration, the door P is closed but not blocked. The door P is blocked when (see FIGS. 7 and 8) a suitable signal of the electronic control unit 51 excites said coil 52, which moves, by means of its movable core and said rod 53, said blocking slider 43 by passing it from said rest position to said operating position. In this way, said projection 431 prevents said blocking member 41 to rotate, forcing it to remain in said locking position, so that said locking pin R remains between said appendix 421 and said hook 412. In addition, when said blocking slider 43 is in said operating position, said further lateral relief 432 allows the pawl 45 to rotate according to the arrow to fit into one of said adjustment grooves 21, blocking the door P and thus preventing accidental openings of the same.

In case of the closure were not optimal, when the door P is closed, for example because of a consumed perimetral gasket of the oven F, such as to require a greater adhesion of the door P, pressing always toward the direction of the arrow C said door P is sufficient. In this case, the detecting slider 42 can reach the stroke end until said abutment formed on said container 31, by sliding said mobile module 3 with respect to said plate 2 (fixed to the oven F or to household appliance in general) always toward the arrow A, against the force of a third spring. In this configuration, when, as described above, said coil 52 drags said blocking slider 43 and the pawl 45 fits in a most rearward adjustment groove 21, thus holding said locked door P in a more advanced position, compensating the closing tolerance.

Naturally, for opening the door-lock device 1, it operates in the opposite way.

In particular, when the coil 52 is de-energized, the second return spring brings said blocking slider 43 from said operating position to said rest position, thus lifting the pawl 45 by means of said further lateral relief 432 and disengaging it or extracting it from the adjustment groove 21, in which it was inserted.

At the same time, the detecting slider 42 returns to said starting position, lifting the blocking member 41, allowing the opening of the door P.

An advantage of the door-lock device according to the present invention is that of obtaining a wide range of tolerance in the closed position of the door at the same time realizing a condition of blocked door in which the available plays, on opening attempt, are reduced.

The present invention has been described for illustrative but not limitative purposes, according to its preferred embodiments, but it is to be understood that modifications and/or changes can be introduced by those skilled in the art without departing from the relevant scope as defined in the enclosed claims.

What is claimed is:

1. A door-lock device to retain closed a door for closing a household appliance, said door being equipped with a locking pin, said door-lock device comprising:

a mobile module having a container, wherein said mobile module is configured to be retained in an initial position by a spring, and wherein said mobile module is configured to slidably move with respect to said household appliance at a position arranged adjacent to said locking pin;

a blocking unit, housed within said container, having a blocking member movable between an unlocking position and a locking position, wherein said blocking member is configured to retain said locking pin when said blocking member is in said locking position and said door is closed;

a detecting slider movable between an initial stroke position and a final stroke position, wherein said detecting slider is configured to be spaced away from with said locking pin of said door when said detecting slider is in said initial stroke position, and wherein said detecting slider is configured to slidably move said mobile module away from said initial position;

a blocking slider movable between a rest position and an operative position, wherein said blocking slider is configured to prevent said blocking member from moving from said locking position to said unlocking position; and a pawl connected to said blocking slider, wherein said pawl is configured to engage one of a plurality of adjustment slots disposed at fixed positions relative to said household appliance when said blocking slider is in said operative position to block said door.

2. The door-lock device according to claim 1, wherein the door-lock device comprises an actuator module adapted to move said blocking slider from said rest position to said operative position.

3. The door-lock device according to claim 2, wherein said actuator module further comprises:

an electronic control unit, a coil operatively connected to said electronic control unit, and a rod connecting said coil to said blocking slider.

4. The door-lock device according to claim 1, wherein the door-lock device comprises a plate configured to be fixed to said household appliance, wherein said plate comprises said plurality of adjustment slots, said mobile module being slidably coupled with said plate.

5. The door-lock device according to claim 1, wherein said detecting slider is arranged alongside said blocking member and has an appendix configured to interact with said locking pin when said door is closed and said detecting slider is in said final stroke position.

6. The door-lock device according to claim 1, wherein said detecting slider comprises a relief to retain said blocking member in said unlocked position when said detecting slider is in said initial stroke position.

7. The door-lock device according to claim 1, wherein:

said blocking member is rotatably coupled with said container and comprises a body and a hook; and said blocking slider comprises a projection arranged to contact said body of said blocking member when said blocking slider is in said operative position to prevent said blocking member from moving from said locking position to said unlocking position, and a lateral relief, shaped so that when said blocking slider is in said rest position, said pawl is kept pin a raised position by said lateral relief, and when said blocking slider is in said operative position, said pawl is in a lowered position so as to engage with said one of said plurality of adjustment slots.

8. The door-lock device according to claim 1, wherein said pawl is rotatably coupled with said blocking slider.

* * * * *